US006640739B2

(12) United States Patent
Woodall et al.

(10) Patent No.: US 6,640,739 B2
(45) Date of Patent: Nov. 4, 2003

(54) AIR-DELIVERED MONOCOQUE SUBMERSIBLE VEHICLE SYSTEM

(75) Inventors: Robert Woodall; Felipe Garcia, both of Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 331 days.

(21) Appl. No.: 09/800,844

(22) Filed: Mar. 8, 2001

(65) Prior Publication Data

US 2002/0134294 A1 Sep. 26, 2002

(51) Int. Cl.[7] ..... B63G 8/00
(52) U.S. Cl. ..... 114/312; 102/411
(58) Field of Search ..... 114/312; 102/411

(56) References Cited

U.S. PATENT DOCUMENTS 6,220,168 B1 * 4/2001 Woodall et al. ..... 102/411
6,286,410 B1 * 9/2001 Leibolt ..... 89/1.809

* cited by examiner

*Primary Examiner*—Jesus D. Sotelo
(74) *Attorney, Agent, or Firm*—Havey A. Gilbert; Donald G. Peck

(57) ABSTRACT

An air-delivered submersible vehicle system has a monocoque-construction shell made from a fiber-reinforced plastic material selected from the group consisting of thermoplastics and thermoset plastics. The shell is equipped with a wing kit so that it can be deployed from an aircraft and fly through the air to a destination at a surface of a body of water. The shell is further equipped as a submersible vehicle so that it can be propelled through the water once it has reached its water destination.

20 Claims, 4 Drawing Sheets

AIR-DELIVERED MONOCOQUE SUBMERSIBLE VEHICLE SYSTEM

ORIGIN OF THE INVENTION

The invention described herein was made in the performance of official duties by employees of the Department of the Navy and may be manufactured, used, licensed by or for the Government for any governmental purpose without payment of any royalties thereon.

FIELD OF THE INVENTION

The invention relates generally to submersible vehicles, and more particularly to a monocoque-body submersible vehicle system that can be delivered in the air to its water destination.

BACKGROUND OF THE INNVENTION

Manned submersible vehicles are used in a variety of naval and civilian activities. "Dry" submersible vehicles are constructed to keep water out of the various operator compartments whereas "wet" submersible vehicles must be piloted by scuba-equipped operators as the vehicle is allowed to fill with water during the submerging thereof. Dry submersible vehicles are generally large and are designed for long underwater missions. Wet submersible vehicles provide a number of advantages when compared to dry submersible vehicles. For example, wet submersibles are neutrally buoyant and, therefore, require less power than a comparablysized dry submersible which needs a greater amount of propulsion power to overcome the vehicle's inherent buoyancy. Thus, wet submersible vehicles can be smaller thereby making them more maneuverable in shallow and/or obstacle-laden water environments. Further, wet submersibles are ideal for search and rescue missions since the operators thereof are already outfitted with scuba gear and can quickly exit the vehicle when needed.

Current state-of-the-art wet submersible hulls are constructed as follows. Individual aluminum frame members are welded together. Fiberglass and aluminum-reinforced panels are then hand-trimmed and fitted over the frame to form the outer skin or body of the vehicle. Each panel is individually machined or cast, polished, and welded to adjacent panels on the frame. Precision alignment tolerances are very difficult to achieve thereby making this construction complex and expensive. Poor tolerances between is the door panels and their openings create undesirable acoustic noise (as the submersible moves through the water) that can be detected by sensors. Further, this type of construction is non-homogeneous which makes it easier to detect acoustically. Still further, the amount of structural metal used makes the resulting vehicle relatively heavy thereby limiting the number of means that can be used to deploy it. That is, current wet submersibles can only be delivered near their ultimate destination by a surface or sub-surface mothership to protect and transport the submersible. The large amount of structural metal used also makes the vehicle more "visible" to both underwater and above-water detectors, e.g., sonar, magnetically-tripped mines, radar, etc.

SUMMARY OF THE INVENTION

Accordingly, it is an object of the present invention to provide a submersible vehicle system.

Another object of the present invention to provide a submersible vehicle system having an improved hull construction.

Still another object of the present invention to provide a submersible vehicle system having a strong, lightweight hull that simplifies and expands the possibilities for deployment thereof.

Yet another object of the present invention to provide a submersible vehicle system having a hull construction of reduced signature in terms of visual radar, magnetic and/or acoustic detectors.

A still further object of the present invention to provide a submersible vehicle system that can be deployed in the air from an aircraft.

Other objects and advantages of the present invention will become more obvious hereinafter in the specification and drawings.

In accordance with the present invention, an air-delivered submersible vehicle system has a monocoque-construction shell made from a fiber-reinforced plastic material selected from the group consisting of thermoplastics and thermoset plastics. The shell has reduced visual, radar, magnetic, and acoustic signatures predicated on the monocoque construction and the materials used. Strength members can be imbedded in the shell during the construction thereof. At least one door is formed integrally in the shell for gaining entrance thereto. The shell is equipped with a wing kit so that it can be deployed from an aircraft and fly through the air to a destination at a surface of a body of water. The shell is further equipped as a submersible vehicle so that it can be propelled through the water.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and herein.

DEATAILED DESCRIPTION OF THE INVENTION

Figure 1:
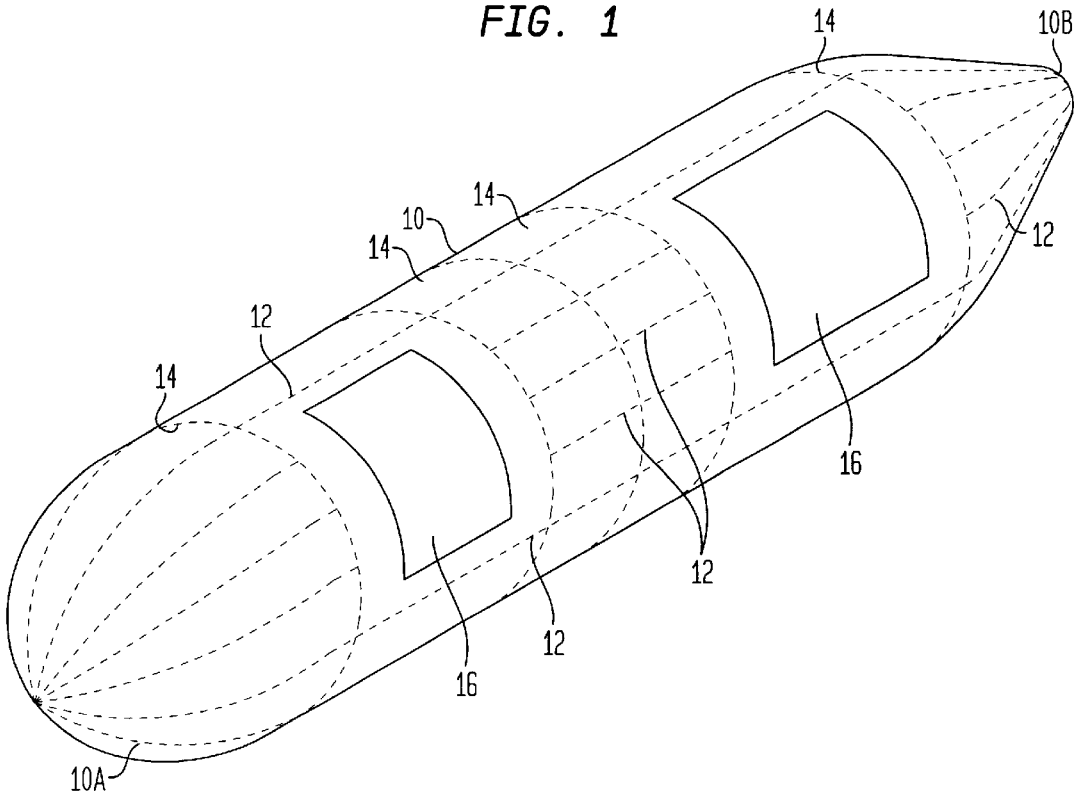
FIG. 1 is a perspective view of a monocoque shell used in the construction of the air-delivered submersible vehicle system according to the present invention.

Referring now to the drawings, and more particularly to FIG. 1, a perspective view of a monocoque-construction hollow shell used as the basis for the submersible vehicle system of the present invention is shown and referenced generally by numeral 10. Monocoque shell 10 has a forward or nose portion 10A and an aft or tail portion 10B. It is to be understood that the particular geometric shape of shell 10 is not a limitation of the present invention. However, in general, shell 10 will have smooth or rounded surface transitions to minimize the generation of turbulence as shell 10 moves through the air or water.

As mentioned, shell 10 is of monocoque construction where "monocoque" is defined herein to mean a type of construction in which a vehicle body is integral with its frame or chassis such that the outer skin of shell 10 carries most or all of the stresses experienced thereby. As such the monocoque structure permits higher strength with light-weight moldable polymeric or plastic-like construction material. The monocoque shell 10 eliminates resonances that are characteristic of structures assembled from multiple parts welded or similarly affixed together. The fabrication of shell 10 can be achieved in a variety of ways, some of which will be described herein. For example, a rotational molding technique could be used to fabricate shell 10. Specifically, the inner portions of a two-part, e.g., upper and lower, mold (not shown) that defines the profile of shell 10 can be sprayed with a releasing agent. Each mold half is then supplied with a pre-determined amount of mold material. The mold halves are clamped together and placed in a rotational mold inside a kiln. Then, as is known in the art of rotational molding, the mold assembly is heated and rotated. At the completion of the heating cycle, the mold assembly continues to rotate until cooled to room temperature. The mold assembly is then opened and monocoque shell 10 is removed. It is to be understood that monocoque shell 10 can be fabricated in other ways than that just described. For example, vacuum or investment casting molding techniques could be used.

In the preferred embodiment of the present invention, the material used to make shell 10 is a fiber-reinforced thermoplastic or thermoset plastic. In general, both of these types of materials are strong, lightweight, can be fabricated to be translucent or transparent thereby making it less visible. These materials can also be mixed with colored pigments thereby allowing shell 10 to be colored to blend into an environment in which it will be deployed. Further, both of these types of materials are much less "visible" (than metal) in terms of their radar, magnetic or acoustic signatures. Of these two materials, thermoplastics are less expensive and easier to work with in the molding process. However, thermoset plastics create three-dimensional crosslinked polymer chains during curing resulting in greater strength, heat resistance, electrical resistance and impact strength than fiber-reinforced thermoplastics. Thus, the monocoque material type selections recited above, combine to provide a structure having the desired signature characteristics.

Although not limited to the following, examples of suitable thermosets include phenolics such as those manufactured by Georgia-Pacific Resins Inc. under the registered trademark BAKELITE, polyvinyl chloride (PVC) and polysulfane. Examples of suitable thermoplastics include nylon, synthetic resinous plastics such as those manufactured by: i) E.I. DuPont de Nemours and Company under the registered trademark DELRIN; ii) General Electric Company under the registered trademarks VALOX, NORYL and LEXAN; iii) Hoechst Celanese Corporation under the registered trademarks CELANEX and VECTRA, just to name a few. Suitable strength materials available in fiber form for reinforcing the thermoplastic or thermoset plastic include, but are not limited to, glass, carbon or aramid (e.g, KEVLAR) fibers.

Strength members can also be embedded in shell 10 during the molding process as indicated by dashed lines 12 and 14 in FIG. 1. Note that the use of dashed lines indicates both the embedded nature of the strength members and their optional use. Strength members 12 extend longitudinally along shell 10 while strength members 14 extend laterally about shell 10. Strength members 12 and/or 14 could be clustered in areas of high stress such as lifting or tow points, around doors or hatches, etc.

Strength members 12 and/or 14 can be pre-tensioned braided fibers (e.g., KEVLAR lines) or rigid rods of strength material strategically placed and fastened to breakaway sections of the mold (not shown) so that the strength members provide tensile and/or compressive strength while the thermoplastic/thermoset material provides compressive strength.

Regardless of the material or the fabrication technique used to construct monocoque shell 10, one or more doors must be provided to gain access to the interior of shell 10. By way of example, fore and aft doors 16 are illustrated. Doors 16 are cut from the completed shell 10 and are, therefore, integral with shell 10. Such integration of doors 16 provides an extremely smooth outer skin that will generate less turbulence as it moves through the air or water. Thus, monocoque shell 10 is inherently aerodynamically and hydrodynamically more efficient than an identically-shaped submersible having the conventional metal frame and panel construction.

Figure 2:
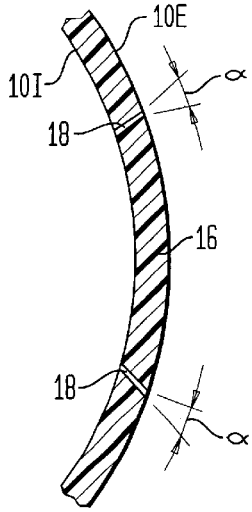
FIG. 2 is a cross-sectional view of a door formed in the monocoque shell.

To ensure a smooth outer surface of shell 10 in the presence of doors 16, the fit between the opening for doors 16 and the perimeter of doors 16 should be complementary. For example, the cuts made to define doors 16 can be non-perpendicular with respect to the outer surface of shell 10. This is best shown in the cross-sectional view of FIG. 2 where the exterior surface of shell 10 is indicated at 10E and the interior surface of shell 10 is indicated at 10I. In general, door cuts 18 are angled towards one another by angle á when viewed from exterior surface 10E. In this way, door 16 will be integral with shell 10 as external pressure is applied to shell 10 at external surface 10E. This contributes to a more effective and reliable closure and seal. This configuration of the door 16 or other means of entry which minimizes the structural disruption that can contribute to notable resonances or other signature perturbations is essential to preservation of the monocoque shell performance.

Figure 3:
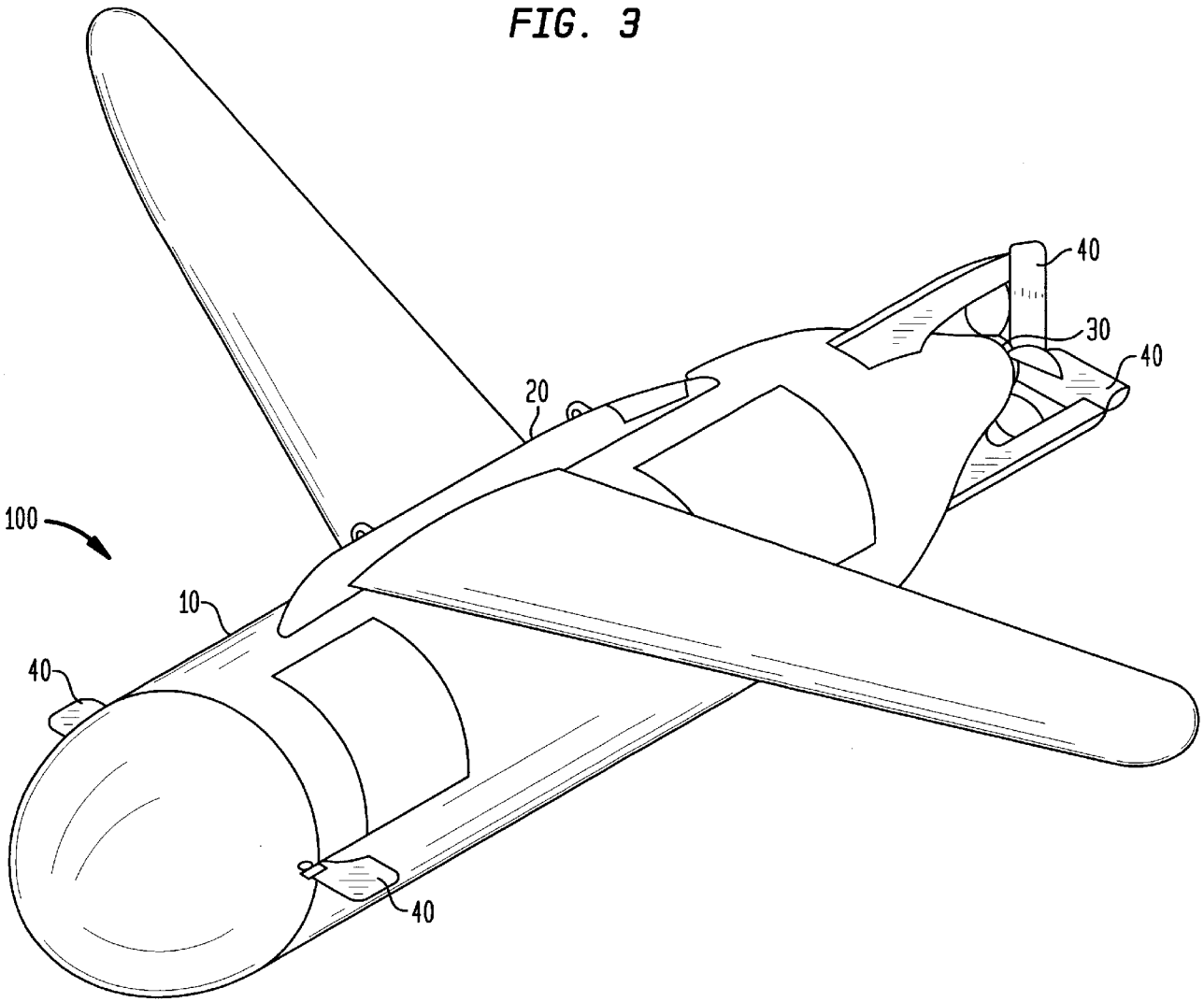
FIG. 3 is a perspective view of the monocoque shell equipped with a wing kit and an underwater propulsion and control surfaces.
Figure 5:
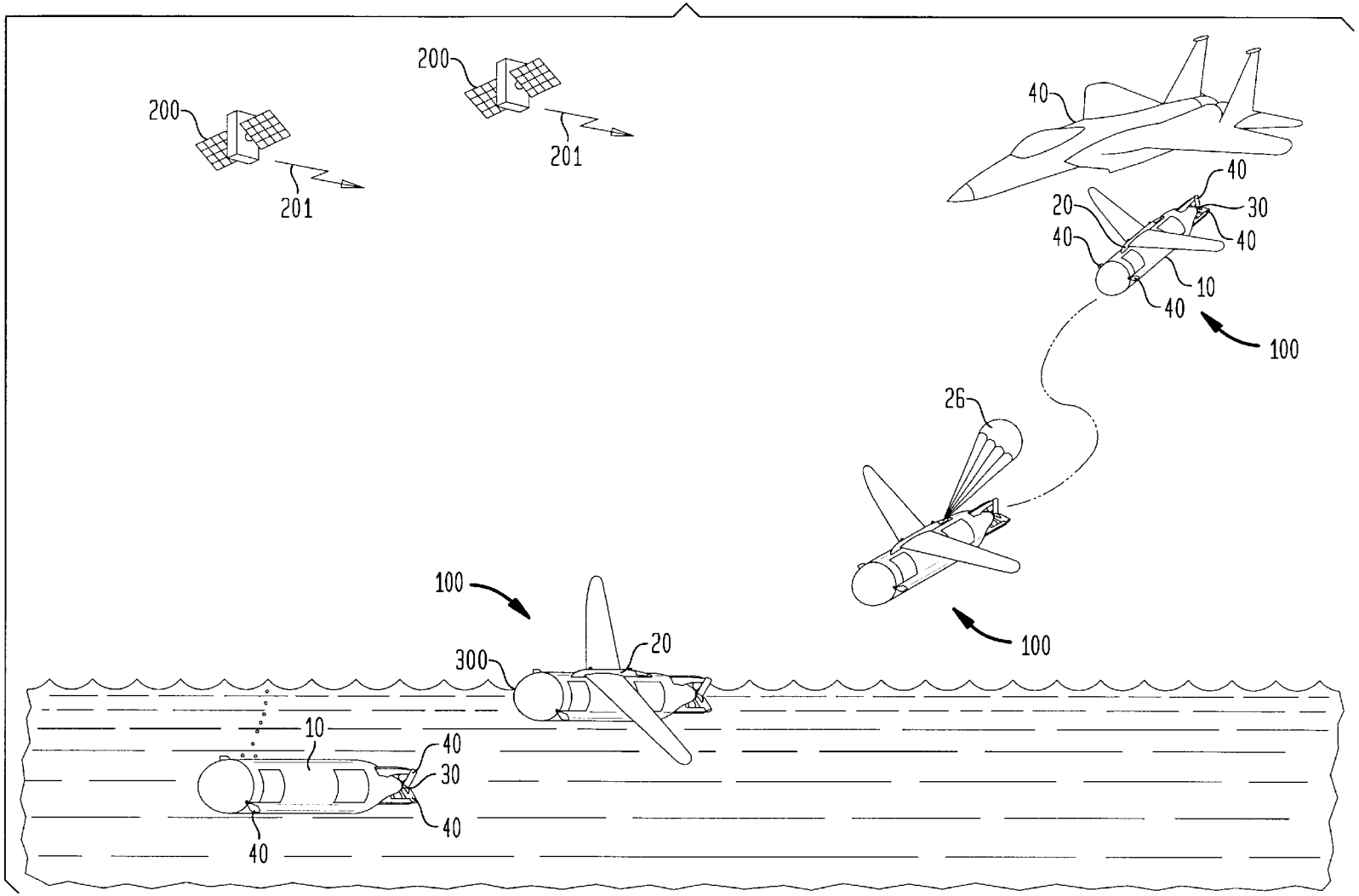
FIG. 5 depicts an operation scenario for the in-air deployment of the submersible vehicle system of the present invention.
Figure 4:
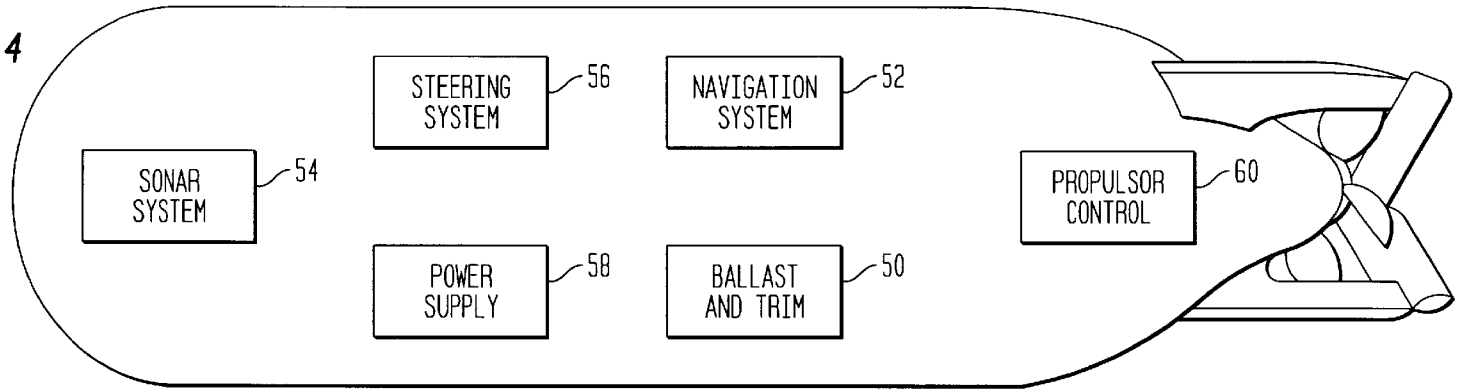
FIG. 4 is a schematic view of the monocoque shell equipped with a variety of systems used to power and control the submersible vehicle in the water.

After monocoque shell 10 with door(s) 16 is fabricated, the remaining parts of the submersible vehicle system 100 of the present invention can be assembled. These will be described with the aid of FIGS. 3 and 4 where FIG. 3 illustrates the external components and FIG. 4 illustrates the internal components of the submersible vehicle system. In FIG. 3, shell 10 is equipped with a glide wing assembly 20 for maneuvering submersible vehicle system 100 through the air. Shell 10 is further equipped with an aft-mounted propulsor assembly 30 and a plurality of movable control surfaces 40 typically mounted at fore and aft areas of system Referring now to FIG. 5, a remote deployment sequence and operation scenario for submersible vehicle system 100 is shown. Similar deployment scenarios for unrelated systems are disclosed by applicants in U.S. patent application Ser. Nos. 09/304,537 and 09/398,549, the contents of which are hereby incorporated by reference. Briefly, a host vehicle 40 travels to the vicinity (e.g., a typical standoff range of 50–75 nautical miles) of an in-air deployment destination at which point submersible vehicle system 100 equipped for air travel is released therefrom. In terms of clandestine operations, host vehicle 40 can be an aircraft (e.g., plane, helicopter, etc.) that can travel quickly to and from the vicinity of deployment without being easily detected by enemy surveillance. Once within the desired vicinity at a desired altitude and air speed, host vehicle 40 releases submersible vehicle system 100 which is capable of maneuvering using GPS signals 201 originating from GPS satellites 200 orbiting the earth in ways that are well understood in the art. Submersible vehicle system 100 can alternatively or additionally be equipped with an onboard inertial navigation system to supplement or back-up the GPS navigation capabilities in the event of GPS signal jamming problems. Submersible vehicle system 100 is maneuvered to a ballistic drop zone approximately above a water deployment destination referenced by numeral 300. To accomplish such navigational maneuvering of submersible vehicle system 100, glide wing assembly 20 is attached to shell 10 as shown in FIG. 3. Once submersible vehicle system 100 begins its terminal descent, a drag device such as a parachute is used to slow the descent of submersible vehicle system 100. After impact with the water's surface at destination 300, the wings of glide wing assembly 20 can be retracted or the entirety of glide wing assembly 20 can be jettisoned so that only shell 10 equipped with propulsor 30 and control surfaces 40 "swims" underwater as illustrated in FIG. 4.

Figure 6:
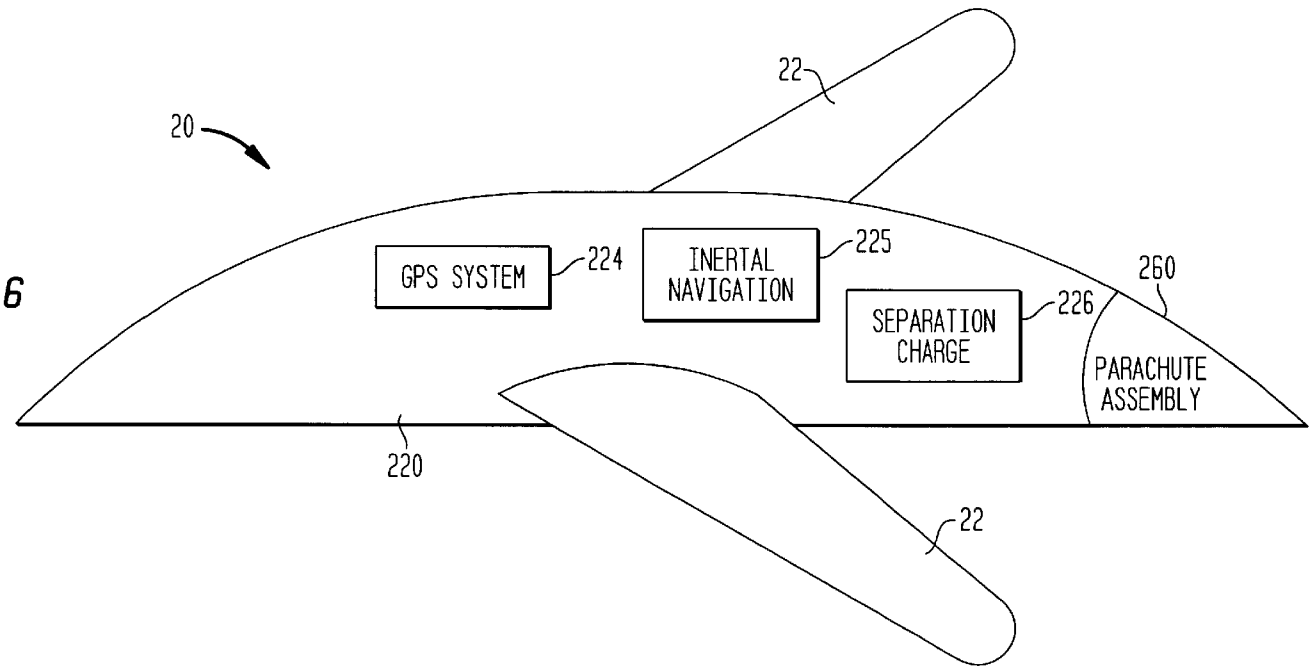
FIG. 6 is a schematic view of the wing kit and drag device coup ed to the monocoque shell.

One embodiment of submersible vehicle system 100 illustrating the details of glide wing assembly 20 is shown schematically in FIG. 6, Glide wing assembly 20 can be a wing "kit" attached to shell 10. The wing "kit" deploys wings 22 to allow submersible vehicle system 100 to glide and steer as a winged aircraft and then jettison (if desired) the wings at a given time or location. A variety of such wing "kits" are known in the art and are available commercially. One such commercially available system is the Longshot™ GPS Guided Wing Kit manufactured by Leigh Aero Systems, Carlsbad, California. Briefly, this wing kit includes a base 220 (mounted to shell 10) with wings 22 that extend therefrom once submersible vehicle system 100 is free from the host aircraft. The wing kit has its own GPS system 224 for determining range and altitude. An inertial navigation system (INS) 225 can also be included as a back-up to GPS system 224. At a desired time, a separation charge 226 can be initiated to cause the combination of base 220 and wings 22 to be jettisoned from shell 10. Base 220 can incorporate a parachute assembly 260 at the aft end thereof for storing a parachute (not shown in FIG. 6) that deploys (see parachute 26 in FIG. 5) from base 220. Once submersible vehicle system 100 has reached its water surface destination 300, parachute 26 is jettisoned. This can be accomplished in a variety of ways well understood in the art. For example, a separation charge (not shown) can be coupled to parachute 26. The separation charge could be initiated by an "on command" RF/wire, an impact sensor or saltwater sensor.

Submersible vehicle system 100 is operated (by onboard personnel or autonomously) as a submersible vehicle once destination 300 is reached. Some of the components needed are illustrated schematically in FIG. 4 where glide wing assembly 20 has been omitted for clarity of illustration. It is to be understood that the choice of components is not limited to those shown and can be tailored to meet specific application needs. Typically, submersible vehicle system 100 will include systems such as a ballast and trim system 50, a navigation system 52 which could include INS/GPS capability for establishing position at the water's surface, a sonar system 54, a steering system 56 coupled to the vehicle's control surfaces (not shown in FIG. 4), a power supply 58, a propulsor control unit 60 coupled to propulsor assembly 30, just to name a few. Submersible vehicle system 100 could be operated as a wet or dry submersible vehicle depending on application needs.

The use of a thermoplastic or thermoset plastic monocoque shell with optional pre-stressed imbedded strength members as the basis for a submersible vehicle provides numerous advantages. The submersible vehicle is strong yet lightweight, i.e., 50% lighter than comparably-sized submersibles constructed with a metal frame and metal/composite panels. The lighter weight means that the submersible vehicle system can be transported and deployed by an airborne aircraft to a target area. The lighter weight also means that a smaller ballast tank can be used thereby freeing up space within the vehicle. The improved plastic monocoque shell presents a smoother outer skin than conventional submersible vehicle designs thereby offering improved aerodynamic and hydrodynamic efficiencies resulting in a low noise stealthy signature. Further, because the shell is made from thermosetting resins, it can even be made translucent or transparent thereby reducing the visible signature of the submersible vehicle. Still further, since all structural metal has been eliminated from the vehicle, the vehicle's radar, magnetic and acoustic signatures are reduced thereby making the submersible vehicle system stealthier both in the air and in the water.

Although the invention has been described relative to a specific embodiment thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. An air-delivered submersible vehicle system, comprising:

a monocoque-construction shell made from a fiber reinforced plastic material selected from the group consisting of thermoplastics and thermoset plastics;

at least one door formed integrally in said shell for gaining entrance thereto;

first means coupled to said shell for guiding said shell through the air to a destination at a surface of a body of water; and second means coupled to said shell for propelling and guiding said shell through said body of water.

2. An air-delivered submersible vehicle system as in claim 1 wherein said first means includes a wing kit coupled to said shell.

3. An air-delivered submersible vehicle system as in claim 2 wherein said wing kit is equipped for at least one of GPS navigation and inertial navigation.

4. An air-delivered submersible vehicle system as in claim 1 further comprising a plurality of strength members embedded in said shell.

5. An air-delivered submersible vehicle system as in claim 4 wherein said plurality of strength members includes strength members extending longitudinally along said shell.

6. An air-delivered submersible vehicle system as in claim 4 wherein said plurality of strength members includes strength members extending laterally about said shell.

7. An air-delivered submersible vehicle system as in claim 1 wherein said shell is at least partially transparent.

8. An air-delivered submersible vehicle system as in claim 1 wherein said shell is at least partially translucent.

9. An air-delivered submersible vehicle system as in claim 1 wherein said shell is colored.

10. An air-delivered submersible vehicle system as in claim 1 wherein a perimeter of said at least one door forms a complementary fit with said shell.

11. An air-delivered submersible vehicle system as in claim 1 wherein said second means includes a propulsion system, a navigation system, and a ballast and trim system.

12. An air-delivered submersible vehicle system, comprising:

a monocoque-construction shell made from a fiber-reinforced plastic material selected from the group consisting of thermoplastics and thermoset plastics;

a plurality of strength members embedded in said shell;

at least one door formed integrally in said shell for gaining entrance thereto;

a wing kit coupled to said shell for guiding said shell through the air to a destination above a surface of a body of water;

a drag device coupled to said shell for slowing said shell descending from said destination above the surface of said body of water to a destination at the surface of said body of water; and means coupled to said shell for propelling and guiding said shell through said body of water.

13. An air-delivered submersible vehicle system as in claim 12 wherein said wing kit is equipped for at least one of GPS navigation and inertial navigation.

14. An air-delivered submersible vehicle system as in claim 12 wherein said plurality of strength members includes strength members extending longitudinally along said shell.

15. An air-delivered submersible vehicle system as in claim 12 wherein said plurality of strength members includes strength members extending laterally about said shell.

16. An air-delivered submersible vehicle system as in claim 12 wherein said shell is at least partially transparent.

17. An air-delivered submersible vehicle system as in claim 12 wherein said shell is at least partially translucent.

18. An air-delivered submersible vehicle system as in claim 12 wherein said shell is colored.

19. An air-delivered submersible vehicle system as in claim 12 wherein a perimeter of said at least one door forms a complementary fit with said shell.

20. An air-delivered submersible vehicle system as in claim 12 wherein said means includes a propulsion system, a navigation system, and a ballast and trim system.

* * * * *